US008088988B2

(12) United States Patent
Randazzo

(10) Patent No.: US 8,088,988 B2
(45) Date of Patent: Jan. 3, 2012

(54) TRIANGULAR MODE GUITAR PICKUP

(76) Inventor: Teddy C. Randazzo, San Jose, CA (US)

( * ) Notice: Subject to any disclaimer, the term of this patent is extended or adjusted under 35 U.S.C. 154(b) by 0 days.

(21) Appl. No.: 12/386,608

(22) Filed: Apr. 22, 2009

(65) Prior Publication Data

US 2010/0269671 A1 Oct. 28, 2010

(51) Int. Cl.
*G10H 3/00* (2006.01)

(52) U.S. Cl. ..... 84/723; 84/730; 84/734; 84/743

(58) Field of Classification Search ..... 84/723–734, 84/743

See application file for complete search history.

(56) References Cited

U.S. PATENT DOCUMENTS 1,209,214 A * 12/1916 Severy ..... 84/726
1,870,576 A * 8/1932 Knoblaugh ..... 84/726
1,893,940 A * 1/1933 Hammond, Jr. ..... 84/723
1,915,858 A * 6/1933 Miessner ..... 84/723
2,027,073 A * 1/1936 Vierling ..... 84/726
2,180,122 A * 11/1939 Severy ..... 84/733
2,239,985 A * 4/1941 Benioff ..... 84/726
2,351,904 A * 6/1944 Ballinger et al. ..... 381/398
2,896,491 A * 7/1959 Lover ..... 84/725
2,976,755 A * 3/1961 Fender ..... 84/727
3,244,791 A * 4/1966 Bloom et al. ..... 84/726
3,453,920 A * 7/1969 Scherer ..... 84/731
3,518,353 A * 6/1970 Appleton ..... 84/726
3,600,496 A * 8/1971 Ellis ..... 84/726
3,629,483 A * 12/1971 Welch ..... 84/726
3,983,778 A * 10/1976 Bartolini ..... 84/726
4,050,341 A * 9/1977 Underwood ..... 84/726
4,064,781 A * 12/1977 Fals ..... 84/322
4,242,937 A * 1/1981 Pozar ..... 84/725
4,248,120 A * 2/1981 Dickson ..... 84/726
4,269,103 A * 5/1981 Underwood ..... 84/726
4,280,018 A 7/1981 Lazarus ..... 381/114
4,356,754 A 11/1982 Fishman ..... 84/731
4,472,994 A * 9/1984 Armstrong ..... 84/726
4,481,856 A * 11/1984 Grawi ..... 84/173
4,727,634 A 3/1988 Fishman ..... 29/25.35
4,774,867 A 10/1988 Fishman ..... 84/731
4,785,704 A 11/1988 Fishman ..... 84/731
4,785,705 A * 11/1988 Patterson ..... 84/726
4,903,566 A * 2/1990 McClish ..... 84/734
4,911,057 A 3/1990 Fishman ..... 84/731
4,944,209 A 7/1990 Fishman ..... 84/731
5,012,086 A * 4/1991 Barnard ..... 250/222.1
5,078,041 A * 1/1992 Schmued ..... 84/731
5,123,326 A * 6/1992 Clevinger ..... 84/743
5,155,285 A 10/1992 Fishman ..... 84/731
5,206,449 A * 4/1993 McClish ..... 84/723
5,212,336 A * 5/1993 Barcus ..... 84/730

(Continued)

OTHER PUBLICATIONS

Bessel Functions and the Kettle Drum: http://en.wikibooks.org/wiki/Acoustics/Bessel_Functions_and_the_Kettledrum.

*Primary Examiner* — David S. Warren

(57) ABSTRACT

An improved transducer structure for musical instruments, principally for stringed instruments, permitting the production of an electrical analog signal which faithfully reproduces sound waves conducted to a sensor from the surface of the instrument through the attachment surface of the transducer and air borne sound waves incident on the elevated structure of the transducer, with nominal distortion. The sensors which are effective using this transducer technology include piezoelectrical sensors, magnetic sensors and capacitive pickups are made part of a symmetric resonant structure none of whose sides are parallel.

12 Claims, 2 Drawing Sheets

U.S. PATENT DOCUMENTS

| | | | | |
|---|---|---|---|---|
| 5,237,126 | A * | 8/1993 | Curtis et al. | 84/724 |
| 5,264,656 | A * | 11/1993 | Itakura et al. | 84/600 |
| 5,319,153 | A | 6/1994 | Fishman | 84/731 |
| 5,463,185 | A | 10/1995 | Fishman | 84/731 |
| 5,486,800 | A * | 1/1996 | Davenport | 333/193 |
| 5,637,818 | A | 6/1997 | Fishman et al. | 84/313 |
| 5,670,733 | A | 9/1997 | Fishman | 84/731 |
| 5,817,966 | A | 10/1998 | Fishman | 84/731 |
| 6,043,422 | A * | 3/2000 | Chapman | 84/723 |
| 6,075,198 | A * | 6/2000 | Grant et al. | 84/731 |
| 6,239,349 | B1 | 5/2001 | Fishman | 84/731 |
| 6,271,457 | B1 | 8/2001 | Hudak | 84/731 |
| 6,392,137 | B1 * | 5/2002 | Isvan | 84/726 |
| 6,429,367 | B2 | 8/2002 | Fishman | 84/730 |
| 6,448,488 | B1 | 9/2002 | Ekhaus et al. | 84/735 |
| 6,476,309 | B2 | 11/2002 | Gaglio | 84/726 |
| 6,605,771 | B1 | 8/2003 | Baggs | 84/731 |
| 6,639,140 | B2 * | 10/2003 | Mishima | 84/600 |
| 6,677,514 | B2 | 1/2004 | Fishman | 84/730 |
| 6,689,943 | B2 | 2/2004 | McGuire, Jr. | 84/291 |
| 6,689,948 | B2 | 2/2004 | Raisanen | 84/733 |
| 6,706,957 | B1 | 3/2004 | Merkel | 84/314 |
| 7,034,218 | B1 * | 4/2006 | Lazarus et al. | 84/723 |
| 7,132,597 | B2 * | 11/2006 | Hosler | 84/723 |
| 7,235,734 | B2 * | 6/2007 | Hosler | 84/725 |
| 7,291,780 | B2 * | 11/2007 | Hosler | 84/725 |
| 7,368,654 | B1 * | 5/2008 | Wai et al. | 84/723 |
| 7,432,431 | B2 * | 10/2008 | Hirota et al. | 84/462 |
| 7,612,282 | B1 * | 11/2009 | Lawing | 84/726 |
| 7,667,128 | B2 * | 2/2010 | Hosler | 84/723 |
| 7,678,987 | B2 * | 3/2010 | Lye | 84/723 |
| 2001/0045156 | A1 * | 11/2001 | Mishima | 84/723 |
| 2002/0083819 | A1 * | 7/2002 | Kinman | 84/726 |
| 2002/0152879 | A1 * | 10/2002 | Raisanen | 84/723 |
| 2003/0177894 | A1 * | 9/2003 | Skinn | 84/730 |
| 2005/0039593 | A1 * | 2/2005 | Wachter | 84/730 |
| 2005/0045027 | A1 * | 3/2005 | Celi et al. | 84/723 |
| 2005/0076775 | A1 * | 4/2005 | Small | 84/743 |
| 2005/0087062 | A1 * | 4/2005 | Kiyohiko | 84/723 |
| 2005/0126375 | A1 * | 6/2005 | Hosler | 84/726 |
| 2005/0126376 | A1 * | 6/2005 | Hosler | 84/726 |
| 2006/0112816 | A1 * | 6/2006 | Kinman | 84/728 |
| 2006/0233081 | A1 * | 10/2006 | Ohta | 369/53.26 |
| 2006/0283311 | A1 * | 12/2006 | Hosler | 84/723 |
| 2007/0245884 | A1 * | 10/2007 | Yamaya | 84/731 |
| 2007/0295196 | A1 * | 12/2007 | Raisanen | 84/737 |
| 2008/0031121 | A1 * | 2/2008 | Katayama et al. | 369/112.29 |
| 2008/0094943 | A1 * | 4/2008 | Tomita et al. | 369/13.53 |

* cited by examiner

TRIANGULAR MODE GUITAR PICKUP

FIELD OF INVENTION

The present invention relates generally to the field of electronic transducers or pickups for musical instruments. The theory which underlies the device however relates to cavity resonators and more particularly to microwave oscillators even though the application is in the field of transducers. In this regard, please see www.uspto.gov/ . . . /week05/OG/html/1339-1/US07485209-20090203.html.

CROSS-REFERENCES

None

STATEMENT REGARDING THE USE OF FEDERAL FUNDS

No federal funding, direct or indirect, has been utilized in conjunction with the development of the present invention.

STATEMENT REGARDING MICROFICHE RECORDS

No microfiche records are used in the application submitted for the present invention.

PUBLICATION

The invention disclosed in this application has not and will not be the subject of an application filed in another country or under a multilateral agreement that requires publication at eighteen months after filing. Pursuant to 35 U.S.C. 122(b), this application is not to be published other than in the United States.

PRIOR ART

No prior art can be found which discloses the present invention. No patents, no publications and no known application disclose the method or apparatus of the present invention.

The prior art has produced many varieties of effective transducers for stringed instruments, however all fail to fully capture the diversity of sound produced in three dimensions by a musical instrument. Except for the present invention, all existing, known or commercial transducers do not respond effectively to incident signals from more than one dimension. The present invention fully integrates all impinging sounds and avoids the common problems which arise from resonant pickup structures, which typically are a box-like structure with parallel sides or round structures both of which suffer from unwanted Bessel function boundary condition problems which give rise to distortion.

Given the fact that the components which are or which may be utilized in implementing the present invention are currently in common use for this type of application, references are given below so as to elaborate upon the unexpectedly superior performance realized by the present invention when compared with existing technologies.

Referring to U.S. Pat. No. 6,706,957 by Steven L. Merkel, deals with means associated with a slotted guitar fretboard and thus is not applicable to the present invention.

Referring to U.S. Pat. No. 6,689,948 by Heikki Eero Raisanen, refers to a transducer which is "uniform thoroughout its length" and thus is inapplicable to the present invention.

Referring to U.S. Pat. No. 6,689,943 by Michael D. McGuire, Jr, refers to a device which is built into the instrument and therefore is not applicable to the present invention.

Referring to U.S. Pat. No. 6,605,771 by Lloyd R. Baggs, relies upon a series of gaps which are monitored and from which detection occurs. The application is remote from the present invention.

Referring to U.S. Pat. No. 6,476,309 by Giovanni Gaglio, refers to a magnetic pickup which is employed in a distinguishable manner from the present invention.

Referring to U.S. Pat. No. 6,271,457 by Willaim Hudak, recites a means dependent upon a pair of sensors which support a mechanical interface which is a technology unrelated to the present invention.

Referring to U.S. Pat. No. 4,280,018 by Arnie Lazarus, recites a box-like structure which fails to resolve the inherent problems of resonance between the parallel sides of such devices. It does not teach the present invention.

All of these transducers lack the favorable characteristics of the present invention. The referenced patents, all of which are typical of the patents and devices found in this field of transducers for musical instruments, fail to realize or to teach the advantages of the present invention.

Attention must now be turned to the patents held by Lawrence Fishman which are set out herein below and which are individually distinguished. However, the Fishman patents fail to disclose the present invention and none teach it.

Referring to U.S. Pat. No. 6,677,514 (Jan. 13, 2004) by Lawrence Fishman, there is disclosed an elctromechanical tape disposed about an inner, conductive core.

Referring to U.S. Pat. No. 6,448,488 (Sep. 10, 2002) by Lawrence Fishman there is disclosed a digital signal process for processing digital information.

Referring to U.S. Pat. No. 6,429,367 (Aug. 6, 2002) and U.S. Pat. No. 6,239,349 (May 29, 2001) by Lawrence Fishman there is disclosed, for both patents, a thin layer of piezoelectric polymer material about an inner, electrically conductive core.

Referring to U.S. Pat. No. 5,817,966 (Oct. 6, 1998), U.S. Pat. No. 5,670,733 (Sep. 2, 1997), U.S. Pat. No. 5,463,185 (Oct. 31, 1995) and U.S. Pat. No. 5,155,285 (Oct. 13, 1992) by Lawrence Fishman there is disclosed, for all four patents, an elongated unitary structure.

Referring to U.S. Pat. No. 5,637,818 (Jun. 10, 1997) by Lawrence Fishman, et al there is disclosed a flat compression spring for the conduction of sound waves.

Referring to U.S. Pat. No. 5,319,153 (Jun. 7, 1994) by Lawrence Fishman there is disclosed a U-shaped channel and an elongated member for the transmittal of sound waves.

Referring to U.S. Pat. No. 4,944,209 (Jul. 31, 1990) by Lawrence Fishman there is disclosed individual sensors for each string of a string instrument.

Referring to U.S. Pat. No. 4,911,057 (Mar. 27, 1990) by Lawrence Fishman there is disclosed a plurality of string saddles for the transmittal of sound waves.

Referring to U.S. Pat. No. 4,785,704 (Nov. 22, 1988), U.S. Pat. No. 4,774,867 (Oct. 4, 1988) and U.S. Pat. No. 4,727,634 (Mar. 1, 1988) by Lawrence Fishman there is disclosed, for all three patents, a conductive adhesive not used by the present invention.

Referring to U.S. Pat. No. 4,356,754 (Nov. 2, 1982) by Lawrence Fishman there is disclosed a wafer size and shape for a transducer.

SUMMARY OF THE INVENTION

The present invention is an device and method for providing an improved transducer for musical instruments.

It an object of the present invention to provide a transducer which, because of its design, fully integrates impinging sound waves from any direction into a well balanced and low distortion output signal.

It is yet another object of the present invention to provide a transducer which is a resonant structure having non-parallel flat sides thus (1) avoiding adverse boundary conditions which for round transducers create unwanted Bessel functions and resulting distortion and (2) avoiding resonance problems which are inherent for box-like transducers and which give rise to unwanted harmonic frequencies.

It is yet another object of the present invention to provide a transducer having substantially high side walls with respect to the dimensions of the base and to have the exit point of electrical conductors through the junction between two side walls thereby leaving the side walls intact and acoustically identical in their responses to impinging sound waves.

It is yet another object of the present invention to provide a transducer having a multisided base, preferably three-sided and symmetric, with no two side walls being parallel.

It is a further object of the present invention to provide a container with side walls and a base for the sensor with rounded interior edges between adjacent walls and between each wall and the base so as to reduce the production of Bessel functions at these interior boundaries.

These and other objects an advantages of the present invention will become clear to those skilled in the art in view of the description of the best presently known mode of carrying out the invention and the applicability of the preferred embodiment as described herein and as illustrated in the several figures of the drawings.

PREFERRED EMBODIMENT OF THE PRESENT INVENTION

The best known implementation and the preferred embodiment of the present invention is the triangular mode guitar pickup, a transducer, as described herein below. The present invention is a new design for a transducer for a musical instrument, commonly a stringed instrument such as a guitar.

Background of the Invention

A transducer is mounted on a musical instrument and functions by converting vibrations created when the instrument is played to electrical signals. These signals are then amplified to produce a comparable, audible effect. A variety of structures for such transducers have been utilized to obtain signals which attempt to faithfully reproduce the sounds of an instrument and which also produce a minimum of distortion. The placement, the orientation, the structure and the size of a transducer each have an impact on quality of the final result and on the types of distortion produced. The use to which an instrument will be put also is a consideration. For example, a guitar played as a solo instrument may require the production of distinctly different characteristics than when it is to be played as part of a presentation by a group of players. Further, the final tonality of an instrument is a factor which is commonly altered by an individual player by the selection of the type of transducer to be used and by determining the precise location on an instrument where it is to be attached. The results, in any case, vary considerably and the subjective opinions of players regarding the related subtle distinctions are commonly passionate and arbitrary.

Preferred Embodiment

The present invention is an apparatus, a method for and means for detecting vibrations produced by a musical instrument when it is played or struck, and further, it is a structure which is effective when utilizing any one of a broad range of types of sensors and attachment means. These sensors include, without preference and without limiting to these items, piezoelectric pickups, magnetic pickups, strain gauges, accelerometers and capacitive pickups.

To understand the range of applications and the details of implementing the present invention, reference is made to the drawings. Referring particularly to the figures wherein like-referenced numbers have been applied to like-parts throughout the description as illustrated in the several figures of the schematic drawings.

Figure 1:
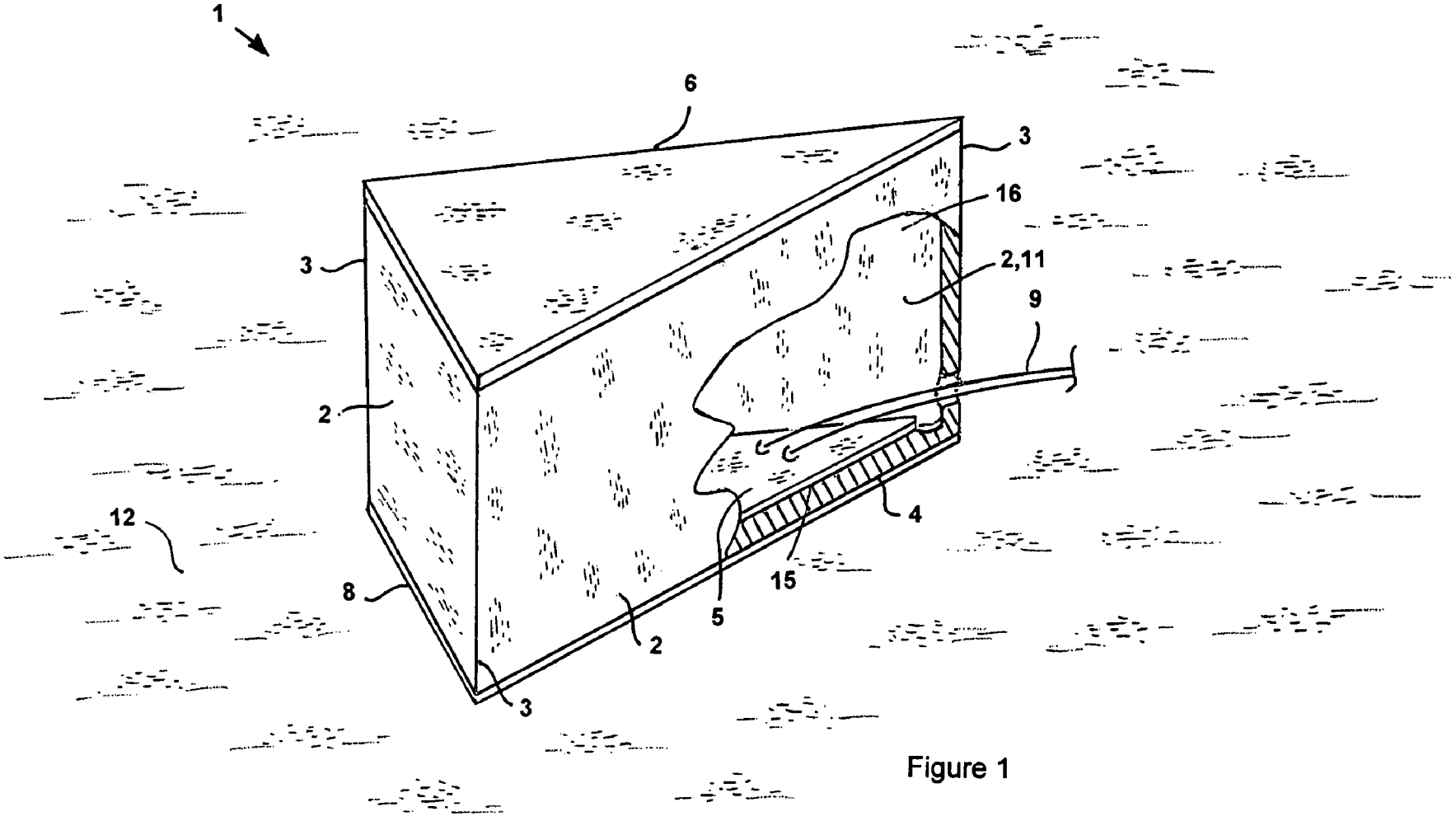
FIG. 1 shows a partial schematic perspective view of the transducer according to the present invention.
Figure 2:
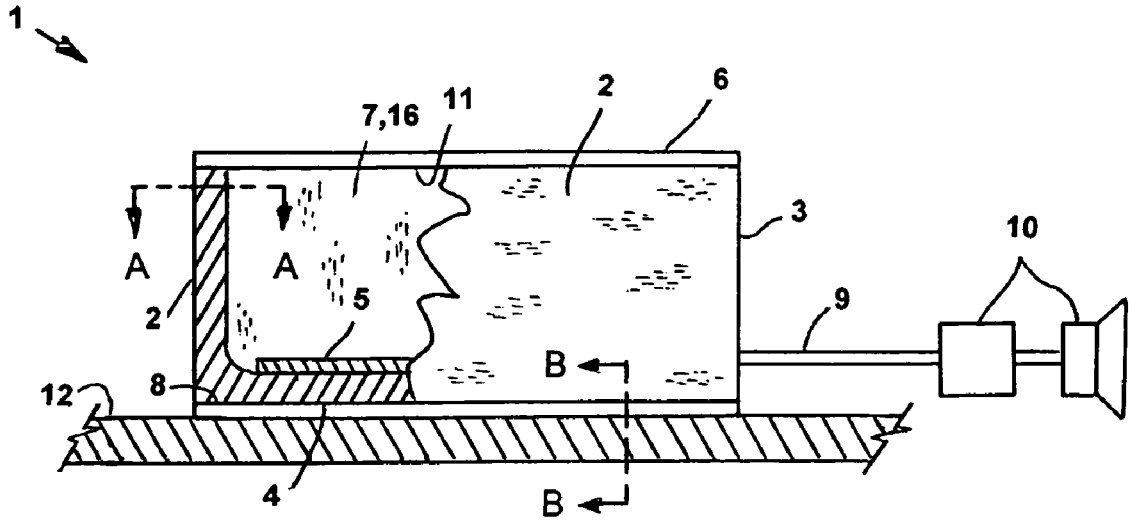
FIG. 2 shows a partial side schematic view of the transducer, an amplifying means and a speaker.

FIG. 1 shows a partial perspective view of a transducer for a musical instrument according to the present invention designated by the general reference number 1 comprised of a flat plate 4, the circumference of said flat plate 4 formed by at least three straight contiguous edges, each hereinafter termed a seam 15, the bottom of said flat plate 4 removably attached to the surface of a musical instrument 12, at least three flat rectangular pieces 2, each of said at least three pieces 2 respectively affixed upwardly from said circumference of said flat plate 4, the bottom long edge of one of said at least three pieces 2 affixed to and along one of said seams 15, adjacent pairs of said at least three pieces 2 upwardly affixed at and along their narrow ends to each other, a junction 3 thereby being formed, a plane parallel to said flat plate 4 formed by the long upper edges of said at least three pieces 2, no two of said at least three pieces 2 being parallel, a sensor 5 affixed to the upper surface of said flat plate 4, electrical connection 9 means connected from said sensor 5 upwardly or through one of said junctions 3 to an amplifier and speaker means 10, said musical instrument 12 is played or struck and vibrations are thereby created, whereby each of said at least three pieces 2 respond in a similar manner to said vibrations, whereby electrical signals are generated in said electrical connection 9 means by said sensor 5 by said vibrations, and whereby said electrical signals are converted by said amplifier and speaker means 10 to audible acoustic waves analogous to the sounds produced by said musical instrument 12 when played or struck as shown in FIG. 2.

The terms triangle, pentagon and heptagon are respectively defined to be regular 3, 5 and 7 sided figures each having equal interior angles and each having equal length sides.

Figure 3A:
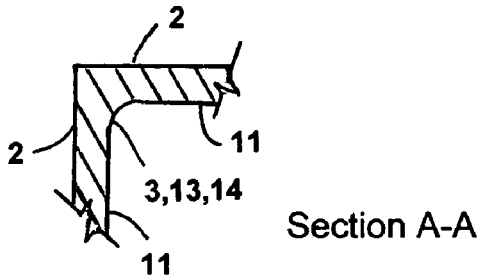
FIG. 3A shows a partial sectional top view of a corner of the transducer.
Figure 3B:
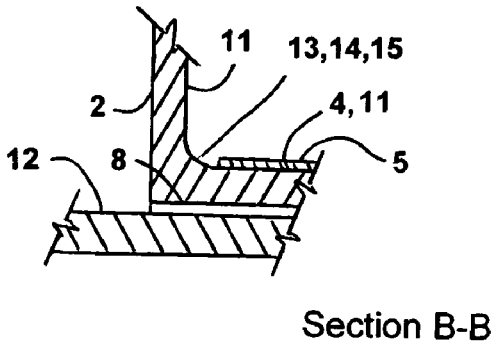
FIG. 3B shows a partial sectional side view of a side and the flat bottom plate.

The present invention is further comprised of a structure wherein (1) said circumference of said flat plate 4 is a triangle, a pentagon (not shown) or a heptagon (not shown) and/or (2) said sensor 5 is a strain gauge, piezoelectric sensor, a magnetic sensor, an accelerometer or a capacitive sensor and/or (3) there are (A) curved interior lengths 13 at and along said junctions 3 and (B) curved interior lengths 13 at and along said seams 15, whereby a rounded interior bottom corner 14 is created at each intersection of an adjacent pair of said seams 15 with the bottom end of one of said a junctions 3 and/or (4) a lid 6 at and on said plane, the outer edges of said lid 6 respectively contiguous with said upper edges of said at least three pieces 2, an enclosed cavity 16 thereby formed by said flat plate 4, said lid 6 and said at least three pieces 2 and/or (5) an electrical conducting surface 11 on the surface of said cavity 16 and/or sound conducting material 7 within said cavity as shown in FIGS. 2, 3A and 3B.

Method of Operation of the Present Invention

The manner of operation of the present invention is as follows. When said musical instrument 12 is played or struck, vibrations are generated which excite said flat plate 4 and said at least three pieces 2 as a single resonant structure. Since no pair of said at least three pieces 2, which extend upward away from said flat plate 4, are parallel, parallel resonance which is found in box-like transducers is avoided. Further since the circumference of said flat plate 4 is comprised of straight edges, said seams 15, the boundary conditions at said seams 15 with said musical instrument 12 do not involve complex Bessel functions as are generated by round transducers. It is by the avoidance of the creation of this type of parallel resonance and by the avoidance of the creation of these types of Bessel functions that the present invention avoids the creation of unwanted distortion. Further, each of said at least three pieces 2 resonates in an identical fashion by reason of excitation by and through said flat plate 4 and by air borne acoustic waves with the beneficial result that the tonality of the instrument 12 is greatly improved. Said curved seams 15, curved junctions 3 and said rounded corners 14 beneficially reduce the amplitude and character of Bessel functions created within said cavity 16. Reference regarding the boundary condition effects of Bessel functions is made to.

Said sensor 5 typically is comprised of a piezo-electric material, an accelerometer, a magnetic pickup or a capacitive pickup. It being understood that magnetic coil pickups, accelerometers, capacitive pickups and piezo-electric pickups are all effective when affixed to the structure described herein. As one skilled in the art would appreciate, each type of sensor has its own peculiarities when being integrated into a given transducer configuration. The core concept of the present invention however does not relate to the type of sensor utilized, but to the configurations set out herein.

The preferred embodiment is the triangular configuration with preferred dimensions of; 0.215 inches (height), 0.50 inches (length of a side) and 0.028 inches (thickness to sides and base). The radius of curvature of the junctions and seams is not critical.

Thus an improved structure for a transducer for a musical instrument has been shown. All of the above are only some of the examples of available embodiments of the present invention. Accordingly, the above disclosure is not intended as limiting and the appended claims are to be interpreted as encompassing the entire scope of the invention.

REFERENCE NUMBERS

Description

| Numbers | Description |
|---|---|
| 1. | General reference number for a transducer according to the present invention |
| 2. | Rectangular piece |
| 3. | Junction |

-continued

| Numbers | Description |
|---|---|
| 4. | Flat plate |
| 5. | Sensor |
| 6. | Lid |
| 7. | Sound conducting material |
| 8. | Adhesive layer |
| 9. | Electrical connection means |
| 10. | Amplifying and speaker means |
| 11. | Electrical conducting surface |
| 12. | Surface of musical instrument |
| 13. | Curved edge |
| 14. | Rounded corner |
| 15. | Seam |
| 16. | Cavity |

What is claimed is:

1. A transducer for a musical instrument comprised of, a flat plate, the circumference of said flat plate formed by at least three straight contiguous edges, each hereinafter termed a seam, the bottom of said flat plate removably attached to the surface of a musical instrument, at least three flat rectangular pieces, each of said at least three pieces respectively affixed upwardly from said circumference of said flat plate, the bottom long edge of one of said at least three pieces affixed to and along one of said seams, adjacent pairs of said at least three pieces upwardly affixed at and along their narrow ends to each other, a junction thereby being formed, a plane parallel to said flat plate formed by the long upper edges of said at least three pieces, no two of said at least three pieces being parallel, a sensor affixed to the upper surface of said flat plate, electrical connection means connected from said sensor upwardly or through one of said junctions to an amplifier and speaker means, said musical instrument is played or struck and vibrations are thereby created, whereby each of said at least three pieces respond in a similar manner to said vibrations, whereby electrical signals are generated in said electrical connection means by said sensor by said vibrations, and whereby said electrical signals are converted by said amplifier and speaker means to audible acoustic waves analogous to the sounds produced by said musical instrument when played or struck.

2. A transducer as in claim 1 wherein said circumference of said flat plate is a triangle, a pentagon or a heptagon.

3. A transducer as in claim 1 wherein said sensor is a strain gauge, piezoelectric sensor, a magnetic sensor, an accelerometer or a capacitive sensor.

4. A transducer as in claim 1 further comprising (1) curved interior lengths at and along said junctions and (2) curved interior lengths at and along said seams, whereby a rounded interior bottom corner is created at each intersection of an adjacent pair of said seams with the bottom end of one of said a junctions.

5. A transducer as in claim 1 further comprised of a lid at and on said plane, the outer edges of said lid respectively contiguous with said upper edges of said at least three pieces, an enclosed cavity thereby formed by said flat plate, said lid and said at least three pieces.

6. A transducer as in claim 5 further comprised of an electrical conducting surface on the surface of said cavity and/or sound conducting material within said cavity.

7. A method for sensing vibrations being produced by a musical instrument when played or struck with a transducer comprised of the following steps;

providing a flat plate with at least three straight contiguous edges, each hereinafter termed a seam, forming its circumference, respectively affixing the bottom long edge of one of at least three flat rectangles to one of said seams, no two of said at least three pieces being parallel and affixing upwardly adjacent pairs of said at least three pieces respectively at and along their narrow ends to each other forming a junction, forming a plane parallel to the top of said flat plate with the long upper edges of said at least three pieces, affixing a sensor to the upper surface of said flat plate, attaching the bottom of said flat plate removably to the surface of said musical instrument, connecting electrical connection means from said sensor upward or through one of said junctions to an amplifier and speaker means, playing or striking said musical instrument and creating vibrations, each of said at least three pieces responding in a similar manner to said vibrations, said sensor responding to said vibrations in said flat plate and in said at least three pieces and thereby generating electrical signals in said electrical connection means, converting said electrical signals with said amplifier and speaker means to audible acoustic waves, whereby providing audible acoustic waves by said steps is analogous to providing said acoustic waves by playing or striking said musical instrument.

8. A method as in claim 7 wherein the step of providing a flat plate is by forming said circumference as a triangle, a pentagon or a heptagon.

9. A method as in claim 7 wherein the step of having said sensor is by providing a strain gauge, piezoelectric sensor, a magnetic sensor, an accelerometer or a capacitive sensor.

10. A method as in claim 7 wherein the step of forming said junctions and said seams is by providing (1) curved interior lengths at and along said junctions and (2) curved interior lengths at and along said seams creating a rounded interior bottom corner at each intersection of an adjacent pair of said seams with the bottom end of one of said a junctions.

11. A method as in claim 7 with the additional step of providing a lid at and on said plane, the outer edges of said lid being respectively contiguous with said upper edges of said at least three pieces thereby, with said flat plate and said three pieces, forming an enclosed cavity.

12. A method as in claim 11 with the additional step of providing an electrical conducting surface on the surface of said cavity and/or providing sound conducting material within said cavity.

* * * * *